United States Patent [19]

Zunkel

[11] Patent Number: 4,726,419

[45] Date of Patent: Feb. 23, 1988

[54] SINGLE ZONE GRAVEL PACKING SYSTEM

[75] Inventor: Gary D. Zunkel, Chickasha, Okla.

[73] Assignee: Halliburton Company, Duncan, Okla.

[21] Appl. No.: 86,237

[22] Filed: Aug. 14, 1987

Related U.S. Application Data

[63] Continuation of Ser. No. 827,312, Feb. 7, 1986, abandoned.

[51] Int. Cl.[4] ..... E21B 43/04

[52] U.S. Cl. ..... 166/51; 166/120; 166/124; 166/278

[58] Field of Search ..... 166/120, 126, 323, 332, 166/334, 124, 278, 205, 51

[56] References Cited

U.S. PATENT DOCUMENTS

| | | | |
|---|---|---|---|
| 3,678,998 | 7/1972 | Cockrell et al. | 166/123 |
| 3,830,294 | 8/1974 | Swanson, Jr. | 166/51 |
| 3,901,318 | 8/1976 | Fortenberry | 166/278 |
| 3,926,409 | 12/1975 | Abney et al. | 251/344 |
| 3,963,076 | 6/1976 | Winslow | 166/278 |
| 3,987,854 | 10/1976 | Callihan et al. | 166/278 |
| 4,049,055 | 9/1977 | Brown | 166/278 |
| 4,096,913 | 6/1978 | Kenneday et al. | 166/290 |
| 4,180,132 | 12/1979 | Young | 166/120 |
| 4,273,190 | 6/1981 | Baker et al. . | |
| 4,401,158 | 8/1983 | Spencer | 166/51 |

*Primary Examiner*—Stephen J. Novosad

*Assistant Examiner*—Bruce M. Kisliuk

*Attorney, Agent, or Firm*—James R. Duzan

[57] ABSTRACT

A setting device for a gravel packing system includes a housing having a slurry supply passage, a fluid return passage and a gravel packing port disposed therein. A weight responsive return valve is operatively associated with the housing for communicating an upper portion of the return passage with a well annulus exterior of the housing in response to reciprocation of a work string to which the setting device is attached. A hydraulic setting piston is operatively associated with the housing for setting a liner hanger of the gravel packing system in response to a first increase in fluid pressure within the supply passage of the housing. A hydraulically actuated supply valve is operatively associated with the housing for communicating the gravel packing port with the supply passage in response to a second increase in fluid pressure in the supply passage. The supply valve includes a sliding supply valve sleeve having an open central passageway extending therethrough open at both the lower and upper end of the sleeve. A check valve is disposed in a lower portion of the housing below the supply valve for permitting flow return fluid upward therethrough and for preventing downward flow therethrough. The gravel packing system includes a liner hanger releasably connected to the setting device, and a liner valve connected to a lower end of the liner hanger.

6 Claims, 15 Drawing Figures

SINGLE ZONE GRAVEL PACKING SYSTEM

This application is a continuation of application Ser. No. 827,312, filed Feb. 7, 1986, now abandoned.

BACKGROUND OF THE INVENTION

1. Field Of The Invention

This invention relates generally to systems for gravel packing a production zone of a well, and more particularly, to a system including a hydraulically activated device for setting a liner hanger of such a system.

2. Description Of The Prior Art

Unconsolidated formations, particularly those containing loose sands and sandstone strata, present constant problems in well production due to migration of loose sands and degraded sandstone into the well bore as the formation deteriorates under the pressure and flow of fluids therethrough. This migration of particles may eventually clog the flow passages in the production system of the well, and can seriously erode the equipment. In some instances, the clogging of the production system may lead to a complete cessation of flow, or killing of the well.

One method of controlling sand migration into a well bore consists of placing a pack of gravel on the exterior of a perforated or slotted liner or screen which is positioned across an unconsolidated formation to present a barrier to the migrating sand from that formation while still permitting fluid flow. The gravel is carried to the formation in the form of a slurry, the carrier fluid being removed and returned to the surface. The proper size of gravel must be employed to effectively halt sand migration through the pack, the apertures of the liner or screen being gauged so that the gravel will settle out on its exterior, with the slurry fluid carrying the gravel entering the liner or screen from its exterior and being circulated back to the surface.

Prior to effecting the gravel pack, drilling mud and other contaminants may be washed from the well bore, and the formation treated. Commonly employed treatments include acidizing to dissolve formation clays, and injecting stabilizing gels to prevent migration of formation components and formation breakdown prior to packing.

Subsequent to effecting the gravel pack, a reverse circulation technique may be utilized to remove remaining gravel laden slurry from the operating string utilized to conduct the slurry. With such a reverse circulation technique, the direction of circulation is reversed and a clean fluid is pumped down the path previously utilized for returning the slurry fluid, and the remaining gravel laden slurry will be forced back up the path originally used to conduct the gravel laden slurry down to the well.

A typical prior art gravel packing system is shown in U.S. Pat. No. 4,180,132 to Young, and assigned to Otis Engineering Corporation. This patent discloses a setting device for a gravel packing system which includes a hydraulically actuated piston 192 for setting the compressible packing element of the packer located therebelow as seen in FIGS. 10A–10E thereof. This device also includes a liner valve located below the packet as seen in FIG. 10E. The setting device includes a valve sleeve 230 having a closed lower end. The valve sleeve 230 can be pumped open to direct gravel laden slurry to the liner valve ports 100 as seen in FIGS. 11E and 11F. The setting device also includes a sliding sleeve type return valve at its upper end, which is arranged to be closed when weight is set down on the setting device.

Another prior art gravel packing system including a hydraulically actuated piston for setting the packer is shown in U.S. Pat. No. 3,987,854 to Callihan et al., and assigned to Baker Oil Tools, Inc. The details of construction of the setting device and packer of the Callihan et al. patent are best seen in FIGS. 4A–4E and 5A–5E thereof.

U.S. Pat. No. 3,678,998 to Cockrell et al., and assigned to Baker Oil Tools, Inc., discloses a retrievable wireline set well packer, which is similar in a number of aspects to the packer disclosed in the Callihan et al. U.S. Pat. No. 3,987,854 patent, and which is constructed to be retrieved by means of a retrieving tool.

Another typical prior art gravel packing system is shown in U.S. Pat. No. 4,049,055 to Brown, and assigned to Brown Oil Tools, Inc. This system includes a hydraulic piston for setting a retrievable compression packer of the gravel packing system. The packer can subsequently be released and retrieved by the use of a retrieving tool seen in FIG. 3.

SUMMARY OF THE INVENTION

The present invention provides a gravel packing system including a hydraulically actuated piston for setting a compressible packer, which while similar in some aspects to the prior art devices cited above, includes a number of significant improvements in such devices. This system provides improvements both in the setting device and in the liner valve means located below the packer. Also, improved methods of gravel packing a well are provided.

The setting device of the gravel packing system of the present invention includes a housing having a slurry supply passage and a fluid return passage therein, and having a gravel packing port disposed through a wall thereof.

A weight responsive return valve means is operatively associated with the housing for communicating an upper portion of the return passage with a well annulus exterior of the housing in response to reciprocation of a work string to which the setting device is attached. The return valve means is in an open position when weight is set down on the setting device, and is in a closed position when a tension load is placed across the setting device.

The setting device includes a hydraulic setting piston means operatively associated with the housing and communicated with the supply passage thereof for setting a liner hanger or packer of the gravel packing system in response to a first increase in fluid pressure in the supply passage.

The setting device also includes a hydraulically actuated supply valve means operatively associated with the housing for communicating the gravel packing port of the housing with the supply passage of the housing in response to a second increase in fluid pressure in the supply passage. The supply valve means includes a sliding supply valve sleeve having an open central passageway extending therethrough and open at both the lower and upper ends of the sleeve. This passageway is communicated with the slurry supply passage of the housing.

A check valve means is disposed in a lower portion of the housing below the supply valve means for permitting flow of return fluid upward therethrough and for preventing downward flow therethrough.

The gravel packing system also includes a liner hanger releasably connected to the setting device, and a liner valve means connected to a lower end of the liner hanger. The liner valve means has a lower portion of the housing received therein so that the gravel packing port of the setting device is in registry with a liner valve port.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 1A, the setting device is shown with its upper end attached to a lower end of a work string and with its lower end in place within a liner hanger and a liner valve means of a liner string, with all of the structures in the positions they would normally be in when the work string, setting device and liner string are initially assembled.

FIG. 4 shows the retrieving apparatus after it has been inserted within the packing apparatus and is ready to release the packing apparatus.

FIG. 5 shows the retrieving apparatus moved upward relative to the packing apparatus. The releasing sleeve has been pulled upward to a position wherein further upward motion of the retrieving apparatus will cause the packer apparatus to be released.

FIG. 6 illustrates the use of a differential area piston of the releasing collet of the retrieving apparatus to release the retrieving apparatus from the packer apparatus in the event that the packer apparatus is stuck in the well and cannot be released by the retrieving apparatus.

DETAILED DESCRIPTION OF THE PREFERRED EMBODIMENTS

Figure 1A:
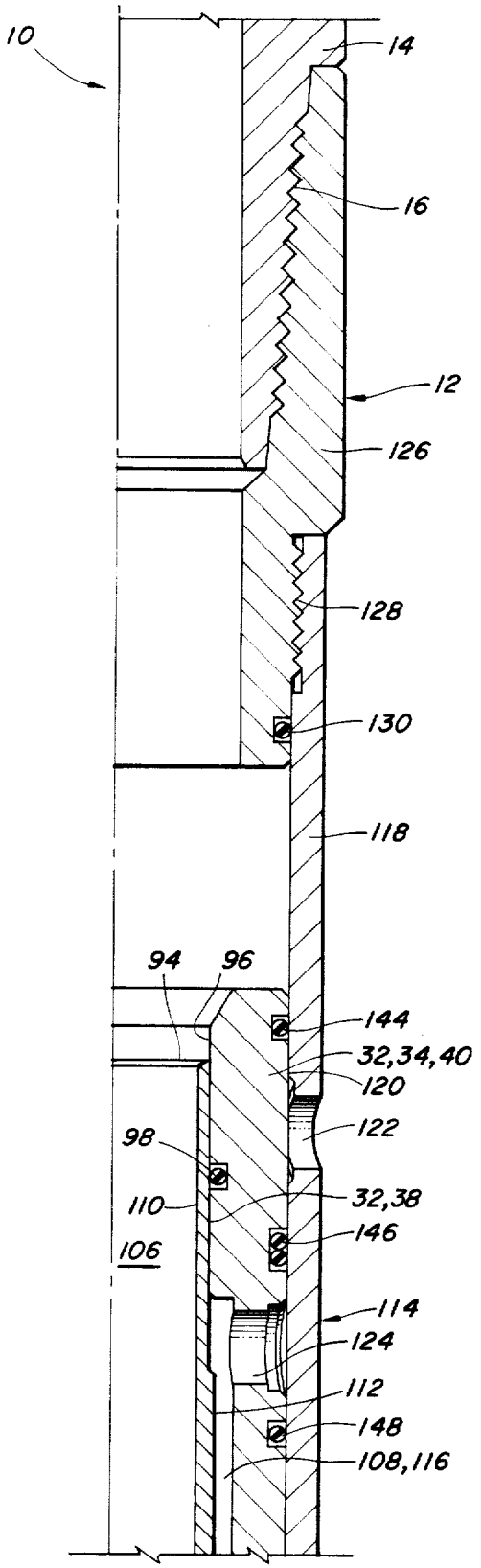
FIGS. 1A-1H comprise an elevation right-side only sectioned view of the gravel packing system of the present invention.

Referring now to the drawings and particularly to FIGS. 1A-1H, the gravel packing system of the present invention is shown and generally designated by the numeral 10.

As shown in FIG. 1A, the system 10 includes a setting device generally designated by the numeral 12 which is attached to a lower end of a work string 14 at threaded connection 16.

As seen in FIGS. 1C-1H, the setting device 12 is assembled with a packer apparatus generally designated by the numeral 18. The packer apparatus 18 is often referred to as a liner hanger because it initially serves to hang a liner string within a well bore.

Figure 1B:
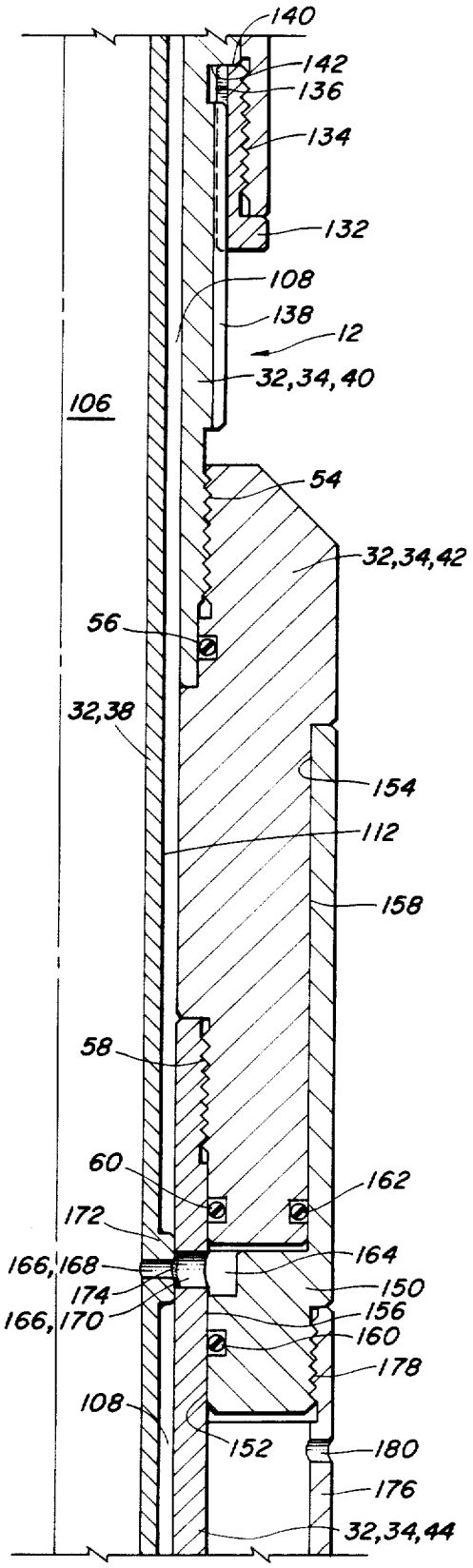
Figure 1C:
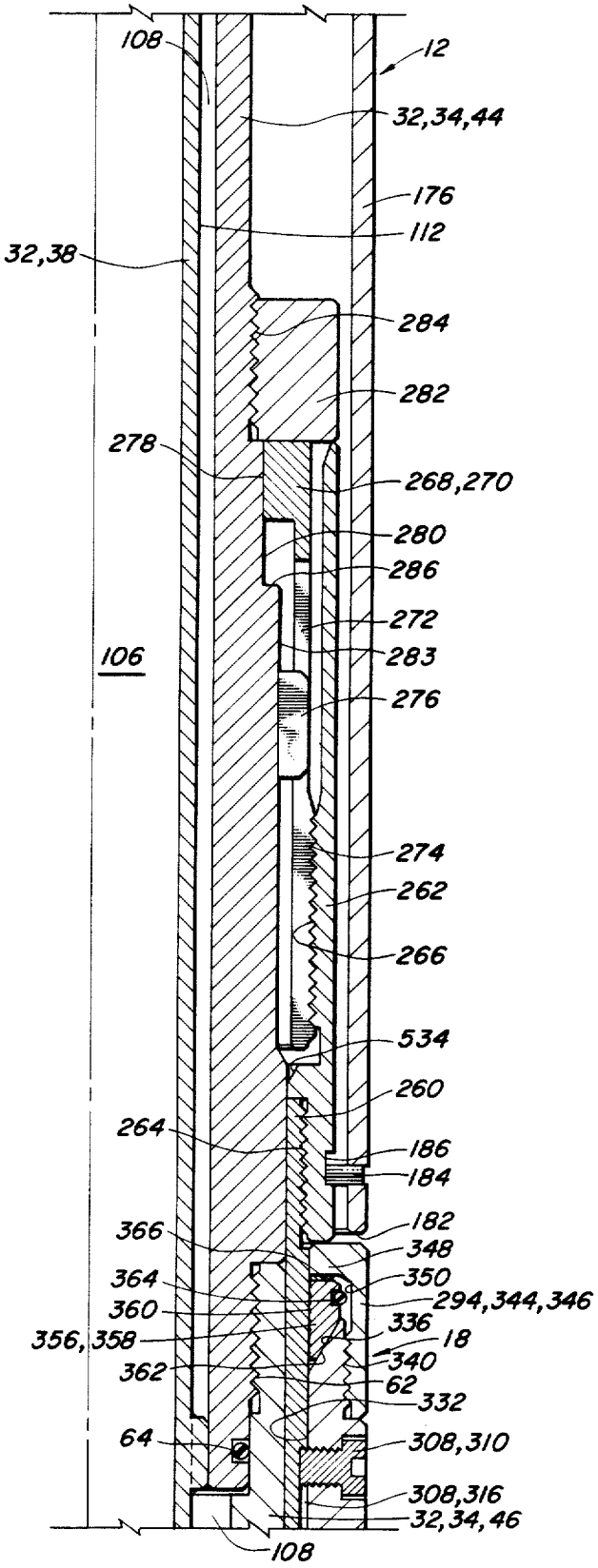
Figure 1D:
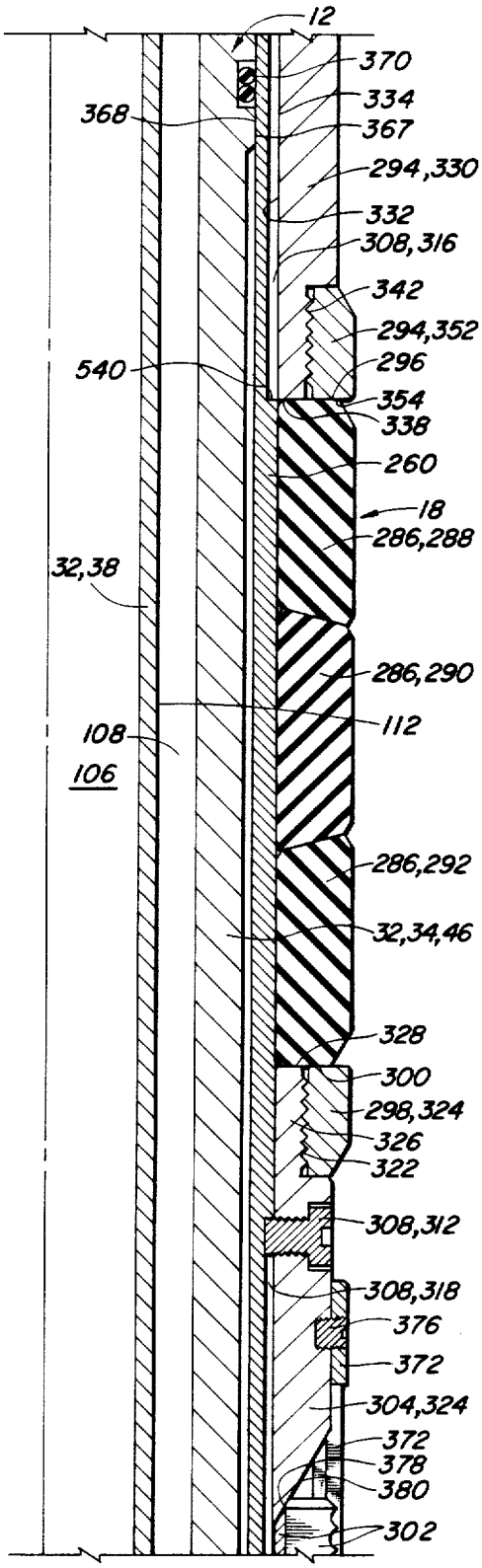
Figure 1E:
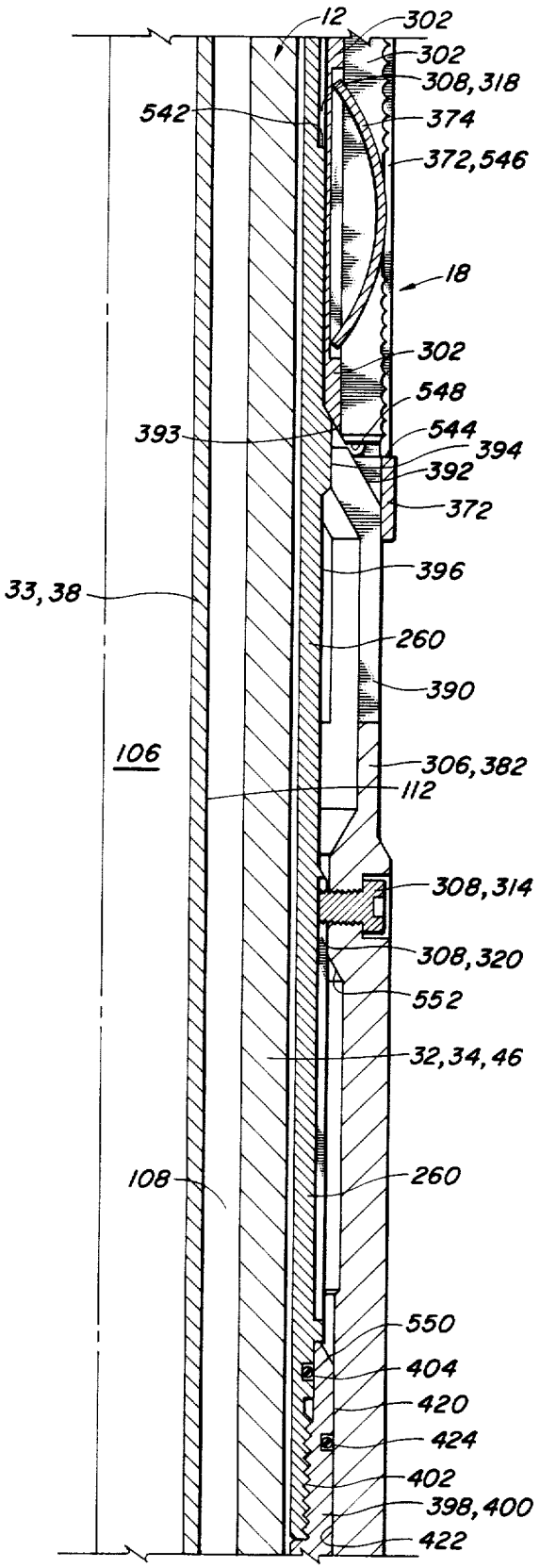
Figure 1F:
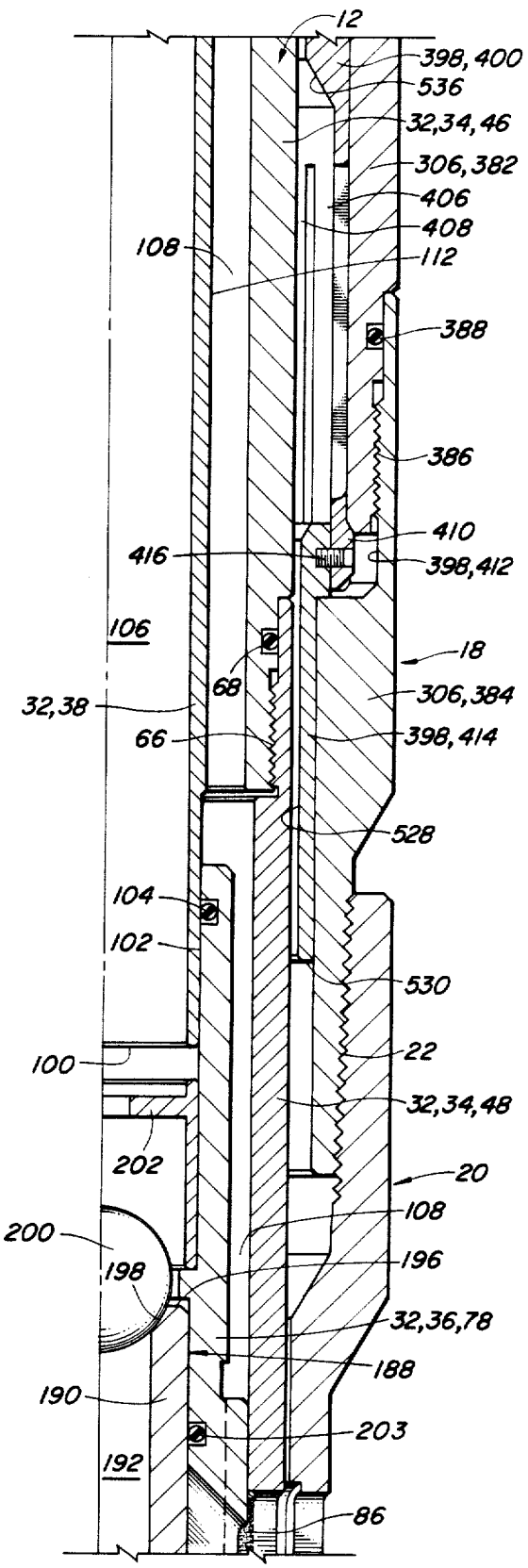

As seen in FIG. 1F, the system 10 also includes a liner valve means 20 connected to a lower end of packer apparatus 18 at threaded connection 22.

Figure 1G:
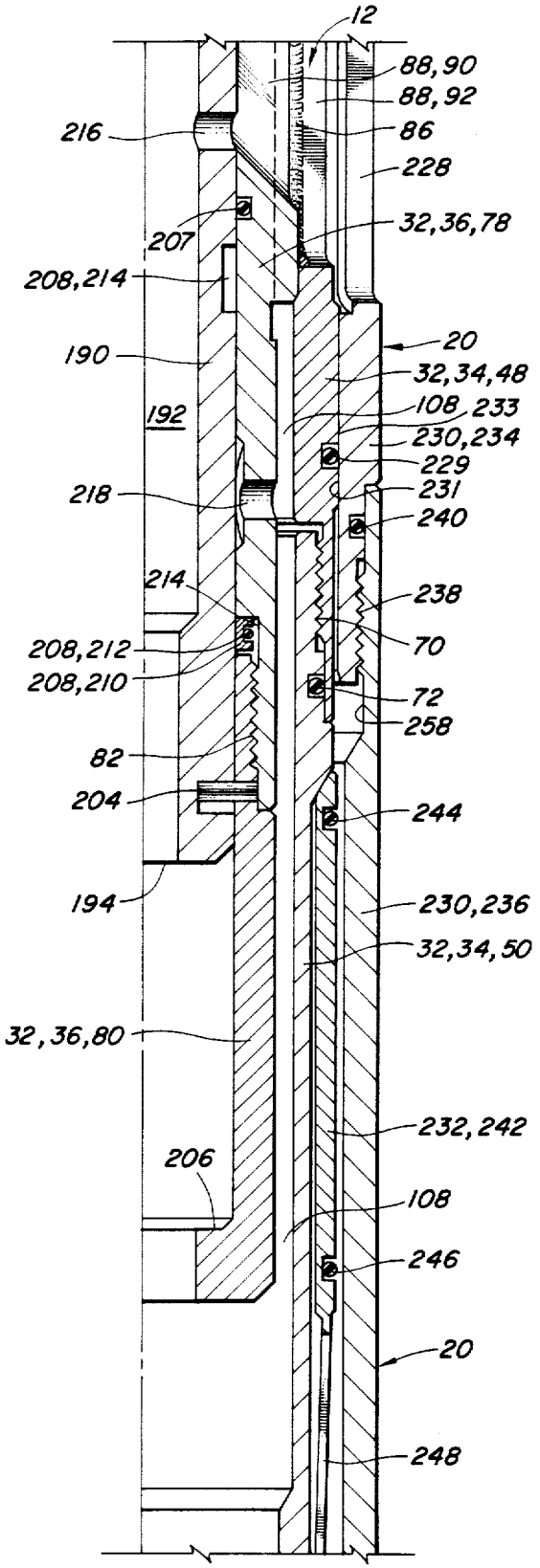
Figure 1H:
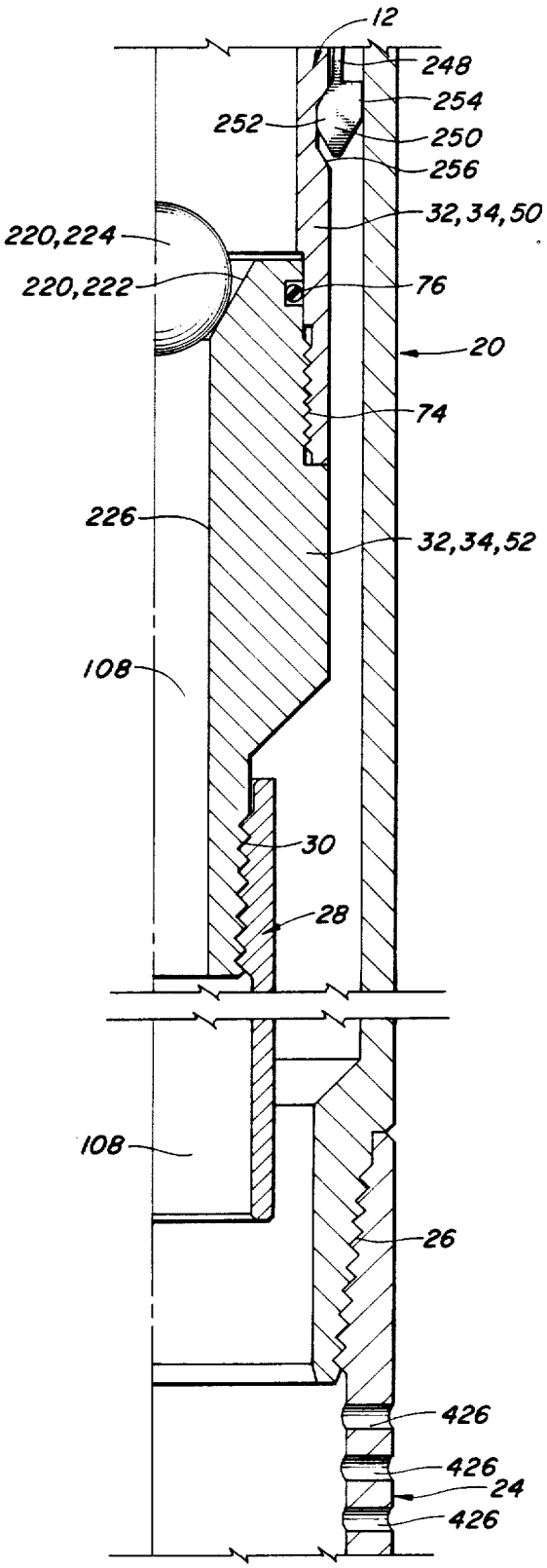

As seen in FIG. 1H, the system 10 also includes a gravel packing screen 24 which is only schematically illustrated. The screen 24 is connected to a lower end of liner valve means 20 at threaded connection 26.

As is also shown in FIG. 1H, the system 10 includes a tail pipe 28 connected to a lower end of setting device 12 at threaded connection 30.

The packer apparatus or liner hanger 18, the liner valve means 20, and the screen 24 may be collectively referred to as a liner string.

DETAILED DESCRIPTION OF THE SETTING DEVICE

The setting device 12 includes a housing 32 comprised of an outer housing assembly 34, a lower inner housing assembly 36, and a central flow tube 38.

The outer housing assembly 34 includes a return valve housing section 40, a piston adapter housing section 42, a connecting collet housing section 44, a packer housing section 46, a supply valve housing section 48, a liner valve housing section 50, and a check valve housing section 52.

Return valve housing section 40 and piston adapter housing section 42 are threadedly connected at threaded connection 54 with a seal being provided therebetween by O-ring 56.

The connecting collet housing section 44 and piston adapter housing section 42 are connected together at threaded connection 58 with a seal being provided therebetween by O-ring 60.

The packer housing section 46 and connecting collet housing section 44 are connected together at threaded connection 62 with a seal being provided therebetween by O-ring 64.

The supply valve housing section 48 and packer housing section 46 are connected together at threaded connection 66 with a seal being provided therebetween by O-ring 68.

The liner valve housing section 50 and supply valve housing section 48 are connected together at threaded connection 70 with a seal being provided therebetween by O-ring 72.

The check valve housing section 52 and liner valve housing section 50 are connected together at threaded connection 74 with a seal being provided therebetween by O-ring 76.

The lower inner housing assembly 36 includes an upper member 78 and a lower member 80 connected together at threaded connection 82.

The lower inner housing assembly 36 is centrally received within the outer housing assembly 34 and fixedly attached thereto by weld 86.

The housing 32 has a gravel packing port 88 disposed through a wall thereof. The gravel packing port 88 includes an inner portion 90 disposed through upper member 78 of lower inner housing assembly 36, and an outer portion 92 disposed through supply valve housing section 48 of outer housing assembly 34. The inner and outer portions 90 and 92 are in registry with each other, and the weld 86 circumscribes the junction between inner and outer portions 90 and 92 of gravel packing port 88.

The central flow tube 38 of housing 32 has an upper end 94 sealingly received in an upper bore 96 of return valve housing section 40 of outer housing assembly 34 with a seal being provided therebetween by O-ring 98.

Central flow tube 38 has a lower end 100 sealingly received in a bore 102 of upper member 78 of lower inner housing assembly 36 with a seal being provided therebetween by O-ring 104.

The housing 32 has a slurry supply passage 106 and a fluid return passage 108 defined therein.

A majority portion of the slurry supply passage 106 is defined by a bore 110 of the central flow tube 38.

The fluid return passage 108 is for the most part an annular fluid return passage, and a majority portion of the return passage 108 is defined between an outer surface 112 of the central flow tube 38 and the outer housing assembly 34.

The gravel packing port 88 of housing 32 extends transversely through, but is isolated from, the annular return passage 108.

The setting device 12 includes a weight responsive return valve means 114 (see FIGS. 1A-1B) operatively associated with the outer housing assembly 34 of housing 32 for communicating an upper portion 116 of fluid return passage 108 with a well annulus exterior of the housing 32 in response to reciprocation of the work string 14.

The return valve means 114 includes a return valve sleeve 118 slidably disposed about an outer cylindrical surface 120 of return valve housing section 40. The return valve sleeve 118 has a sleeve port 122 disposed therethrough.

The return valve housing section 40 has a housing port 124 disposed therethrough, which may be considered to be a part of the return valve means 114. The housing port 124 is communicated with the upper portion 116 of return passage 108.

An upper adapter 126 is threadedly connected to return valve sleeve 118 at threaded connection 128 with a seal being provided therebetween by O-ring 130. The upper adapter 126 provides a connecting means for connecting an upper end of the setting device 12 to the work string 14 at threaded connection 16 previously mentioned.

Return valve means 114 further includes a splined connector cap 132 threadedly connected to return valve sleeve 118 at threaded connection 134. Connector cap 132 includes a plurality of radially inward extending splines 136 which are meshed with a plurality of radially outward extending splines 138 of return valve housing section 40 so that relative longitudinal movement of return valve sleeve 118 relative to outer housing assembly 34 is permitted, while relative rotational movement therebetween is prevented.

In FIGS. 1A-1B, the return valve sleeve is shown in an uppermost closed position relative to outer housing assembly 34. This uppermost position is defined by abutment of an upper end 140 of connector cap 132 with a downward facing annular shoulder 142 of return valve housing section 40.

Return valve means 114 includes first, second and third O-ring seal means 144, 146 and 148, respectively, for sealing between return valve housing section 40 and return valve sleeve 118.

When return valve sleeve 118 is in its uppermost closed position relative to outer housing assembly 34, the sleeve port 122 is located between seals 144 and 146, and the housing port 124 is located between seals 146 and 148, so that sleeve port 122 is isolated from housing port 124.

When weight is set down upon the setting device 12 by means of the work string 14, the return valve sleeve 118 will move downward to a lower position relative to outer housing assembly 34 in which the sleeve port 122 is in registry with the housing port 124 so as to communicate the return passage 108 with the well annulus exterior of the setting device 12.

The setting device 12 further includes a hydraulic setting piston means 150, operatively associated with the housing 32 and communicated with the central supply passage 106 for setting the packer apparatus 18 of the gravel packing system 10 in response to a first increase in fluid pressure in the supply passage 106 to a first value.

The setting piston 150 has a bore 152 and a counterbore 154 within which are closely received cylindrical outer surfaces 156 and 158 of connecting collet housing section 44 and piston adapter housing section 42, respectively.

A smaller diameter O-ring seal 160 carried by piston 150 seals against connecting collect housing section 44, and a larger diameter seal 162 seals between piston adapter housing section 44 and counterbore 154. The effective differential area of setting piston 150 is defined between seals 160 and 162.

An annular power chamber 164 is defined between connecting collet housing section 44 of outer housing assembly 34 of housing 32 and the setting piston 150.

Housing 32 includes a transverse passage 166 which communicates central supply passage 106 with the annular power chamber 164.

Transverse passage 166 includes a first portion 168 disposed radially through an enlarged diameter portion 172 of central flow tube 38, and a second portion 170 disposed through connecting collet housing section 44.

The first and second portion 168 and 170 are in registry with each other and a weld 174 circumscribes the junction therebetween.

Thus, the tranverse passage 166 extends transversely through, but is isolated from, the annular return passage 108.

Fluid pressure from within central supply passage 106 is tranferred through transverse passage 166 to the annular power chamber 164 above setting piston 150, so that the setting piston 150 can be forced downward relative to housing 32 in response to an increase in pressure within the supply passage 106 to a predetermined first value.

A cylindrical tubular setting sleeve 176 is connected to the lower end of setting piston 150 at threaded connection 178. A relief port 180 is disposed through sleeve 176.

Setting sleeve 176 has a lower end 182 arranged for engagement with the packer apparatus 18 to set the packer apparatus 18 in a manner that will be further described below.

Setting sleeve 176 is initially retained in position relative to the packer apparatus 18 by a plurality of shear pins 184 disposed through the sleeve 176 and received in an annular groove 186 of the packer apparatus 18.

The setting device 12 also includes a hydraulically actuated supply valve means 188 operatively associated with the lower inner housing assembly 36 of housing 32 for communicating the gravel packing port 88 of housing 32 with the central supply passage 106 of housing 32 in response to a second increase in fluid pressure in the central supply passage 106 to a second value greater than the previously mentioned first value.

The supply valve means 188 includes a sliding supply valve sleeve 190 having an open central passageway 192 extending therethrough and open at both a lower end 194 and an upper end 196 of supply valve sleeve 190. The open central passageway 192 of supply valve sleeve 190 is communicated with the central slurry supply passage 106.

An annular seat 198 circumscribes an upper end of open central passageway 192 for receiving a closure ball 200 therein.

A retaining cage 202 is disposed in bore 102 of upper member 78 of lower inner housing assembly 36 to keep the closure ball 200 in place near the supply valve sleeve 190.

An O-ring 203 seals between upper member 78 of lower inner housing assembly 36 and supply valve sleeve 190.

When fluid pressure is increased in the central slurry supply passage 106, a downward pressure differential across closure ball 200 causes ball 200 to seal on seat 198 so that a downward pressure differential is imposed on supply valve sleeve 190.

The supply valve sleeve 190 is initially retained in an upper closed position relative to lower inner housing assembly 36 by one or more shear pins 204 as seen in FIG. 1G.

When fluid pressure within central slurry supply passage 106 reaches a predetermined value, the downward force exerted on supply valve sleeve 190 will shear the pins 204 and the supply valve sleeve 190 will move down to a lower open position defined by abutment of lower end 194 of supply valve sleeve 190 with a radially inward extending flange 206 of lower member 80 of lower inner housing assembly 36.

When supply valve sleeve 190 is in this lower position, an O-ring 207 seals between upper member 78 of lower inner housing assembly 36 and supply valve sleeve 190 below the gravel packing port 88.

The shear pins 204 can generally be referred to as a releasable retaining means 204, operatively associated with the supply valve sleeve 190 and the lower inner housing assembly 36 of housing 32, for initially retaining the supply valve sleeve 190 in a closed position blocking the gravel packing port 88.

When the supply valve sleeve 190 is moved downward to its lower open position, a locking means 208, operatively associated with the supply valve sleeve 190 and the lower inner housing assembly 36 of housing 32 locks the supply valve sleeve 190 in its lower open position. Locking means 208 includes a plurality of separate locking dogs 210 surrounded by an annular resilient band 212 which biases the dogs 210 radially inward. As seen in FIG. 1G, the locking dogs 208 are initially located within a groove 214 defined between upper and lower members 78 and 80 of lower inner housing assembly 36.

When the supply valve sleeve 190 is moved downward relative to lower inner housing assembly, the locking dogs 210 will move radially inward into engagement with a groove 214 of supply valve sleeve 190 thus preventing supply valve sleeve 190 from moving back upward.

Supply valve sleeve 190 has a run-in fill port 216 disposed through a wall thereof. Port 216 communicates with gravel packing port 88, when sleeve 190 is in its initial upper position, to allow the work string 14 to fill with well fluid as the gravel packing system 10 is lowered into a well. The well fluid flows in through gravel packing port 88 and fill port 216, then up around ball 200 and through supply passage 106. Well fluid can also enter through screen 24 to fill the work string 14.

When supply valve sleeve 190 is in its lowermost open position, the run-in fill port 216 through supply valve sleeve 190 is communicated with a port 218 disposed through upper member 78 of lower inner housing assembly 36 to aid in the flow of clean fluid from return passage 108 to supply passage 106 during reverse circulation. This also provides a safety feature in the event the check valve ball 224 were to become stuck against the open lower end of lower member 80 of lower inner housing assembly 36, or in the event the open lower end of lower member 80 became plugged in some other manner.

The setting device 12 further includes a check valve means 220, disposed in a lower portion of the housing 32 below the supply valve means 188 for permitting flow of return fluid upward therethrough and for preventing downward flow therethrough.

The check valve means 220 includes an annular check valve seat 222 and a check valve ball 224.

The annular check valve seat 222 circumscribes an upper end of a central bore 226 of check valve housing section 52. Bore 226 defines a portion of the return passage 108 of housing 32.

As will be further explained below, the check valve means 220 provides a means for directing reverse circulation fluid traveling down through those portions of return passage 108 above check valve means 220, up through the open central passageway 192 of supply valve sleeve 190 and up through the central slurry supply passage 106 of housing 32 to remove excess slurry from the setting device 12.

Setting device 12 includes a releasable connecting means 268 operatively associated with connecting collet housing section 44 for releasably connecting the setting device 12 to an internal left-handed thread 266 of packer apparatus 18.

Prior to lowering the work string 14, setting device 12, packer apparatus 18, liner valve means 20 and screen 24 into a well, the releasable connecting means 268 will be connected to the packer apparatus 18 as shown in FIG. 1C.

The releasable connecting means 268 includes an upper collet ring portion 270 having a plurality of connecting collet spring fingers 272 extending downward therefrom. Each of the spring fingers 272 includes a radially outer left-hand threaded surface 274 for threadedly engaging the internal left-hand threaded surface 266 of the packer apparatus 18.

A plurality of lugs 276 extend radially outward from connecting collet housing section 44 through the spaces between adjacent connecting collet spring fingers 272 so that the releasable connecting collet means 268 is rotationally fixed relative to the connecting collet housing section 44.

Some longitudinal movement of releasable connecting collet 268 relative to connecting collet housing section 44 is permitted. A bore 278 of ring portion 270 is slidably received about an outer cylindrical surface 280 of connecting collet housing section 44. A limit ring 282 is threadedly connected to connecting collet housing section 44 above outer cylindrical surface 280 at threaded connection 284. The limit ring 282 limits upward movement of releasable connecting collet 268 relative to connecting collet housing section 44. An upward facing annular shoulder 286 of connecting collet housing section 44 will abut ring portion 270 of releasable connecting collet 268 to limit downward movement of connecting collet 268 relative to connecting collet housing section 44.

In FIG. 1C, the ring portion 270 of collet 268 is shown abutting the limit ring 282 as it would when the setting device 12 is stabbed into the packer apparatus 18 to make up the left-hand threads 266 and 274. When the gravel packing system 10 is being lowered into the well, the packer apparatus 18 and collet 268 will drop down relative to housing 32 of setting device 12 until ring portion 270 abuts shoulder 286. In that position, the lower portions of fingers 272 engage an enlarged diameter outer surface 283 of connecting collet housing sectoin 44 to prevent the fingers 272 from being biased inward.

As is further described below, after the packing apparatus 18 has been set in a well bore, the setting device 12 is disconnected from packing apparatus 18 by right-hand rotation of the work string 14 and setting device 12 which disconnects the left-hand threaded outer surfaces 274 of connecting collet spring fingers 272 from the internal left-handed thread 266 of packing apparatus 18.

DETAILED DESCRIPTION OF THE LINER VALVE MEANS

As seen in FIGS. 1F-1G, the liner valve means 20 of the gravel packing system 10 has a lower portion of the housing 32 of setting device 12 received therein so that the gravel packing port 88 of the settng device 12 is in vertical registry with a liner valve port 228 of liner valve means 20.

The liner valve means 20 includes a liner valve body 230 and a liner valve sleeve 232 slidably disposed in the liner valve body 230.

The liner valve body 230 includes an upper body section 234 and a lower body section 236 connected together at threaded connection 238 with a seal being provided therebetween by O-ring 240. An O-ring seal 229 seals between a bore 231 of upper body section 234 and an outer surface 233 of supply valve housing section 48.

The liner valve port 228 is disposed through the upper body section 234.

The liner valve sleeve 232 is operably associated with the liner valve housing section 50 of outer housing assembly 34 of housing 32 so that when the housing 32 is received in the liner valve means 20 as seen in FIGS. 1F-1H, the liner valve sleeve 232 is located below the liner valve port 228, so that the gravel packing port 88 of housing 32 is communicated with the liner valve port 228.

The liner valve sleeve 232 includes a cylindrical tubular sealing portion 242 having first and second longitudinally spaced O-ring seals 244 and 246 disposed in radially outer grooves thereof. Liner valve sleeve 232 also includes a plurality of downward extending spring collet fingers 248, each having a lower head 250 including both a radially inward extending lug 252 and a radially outward extending lug 254.

The setting device 12 and liner valve means 20 are so arranged and constructed that when the housing 32 of setting device 12 is received within the liner valve means 20 with the gravel packing port 88 in registry with the liner valve port 228, the spring collet fingers 248 are cammed radially inward as seen in FIGS. 1G and 1H so that the inward extending lugs 252 are latched in an annular outer groove 256 of liner valve housing section 50 housing 32 so that the liner valve sleeve 232 is releasably longitudinally fixed relative to the housing 32.

When the housing 32 of setting device 12 is later withdrawn from the liner valve means 20, the liner valve sleeve 232 is pulled upward with the housing 32 relative to the liner valve body 230 until the liner valve sleeve reaches an upper closed position wherein liner valve port 228 is located longitudinally between O-ring seals 244 and 246 thus closing liner valve port 228. When the liner valve sleeve 232 is in this upper closed position, the spring collet fingers 248 spring radially outward to disengage from the liner valve housing section 50 of housing 32 and to engage a radially inward facing annular groove 258 defined between upper and lower body sections 234 and 236 of liner valve body 230 to thus releasably latch the liner valve sleeve 232 in its upper closed position blocking the liner valve port 228.

DETAILED DESCRIPTION OF THE PACKER APPARATUS

Figure 2A:
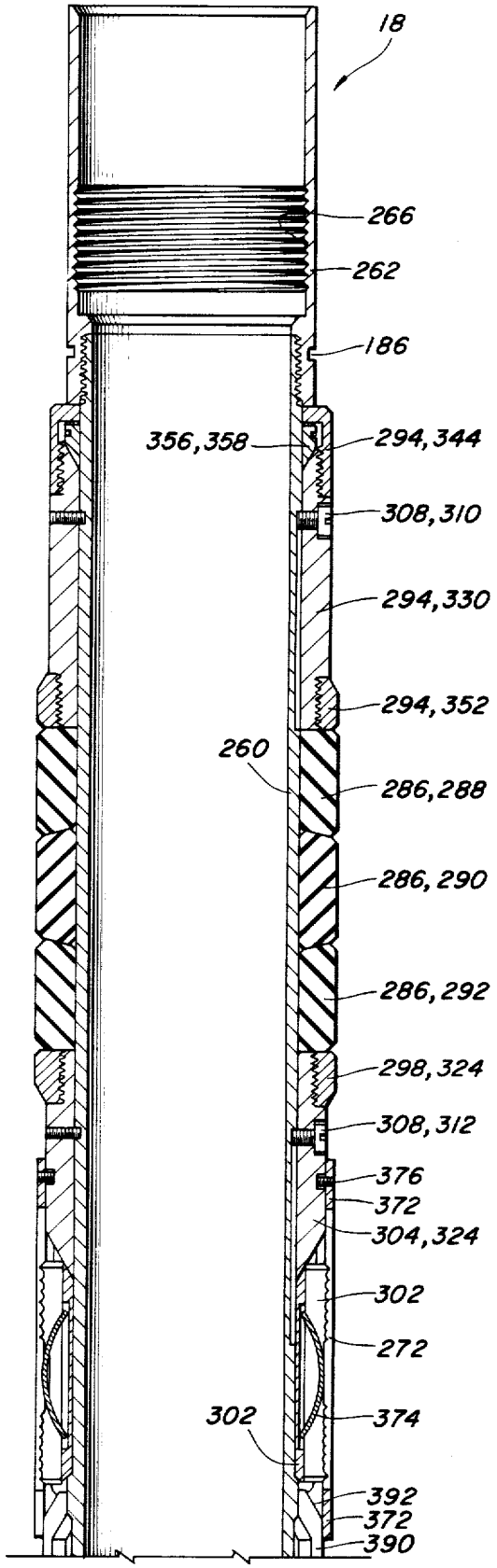
FIGS. 2A-2B comprise an elevation sectioned view of the packer or liner hanger of the gravel packing system of the present invention.
Figure 2B:
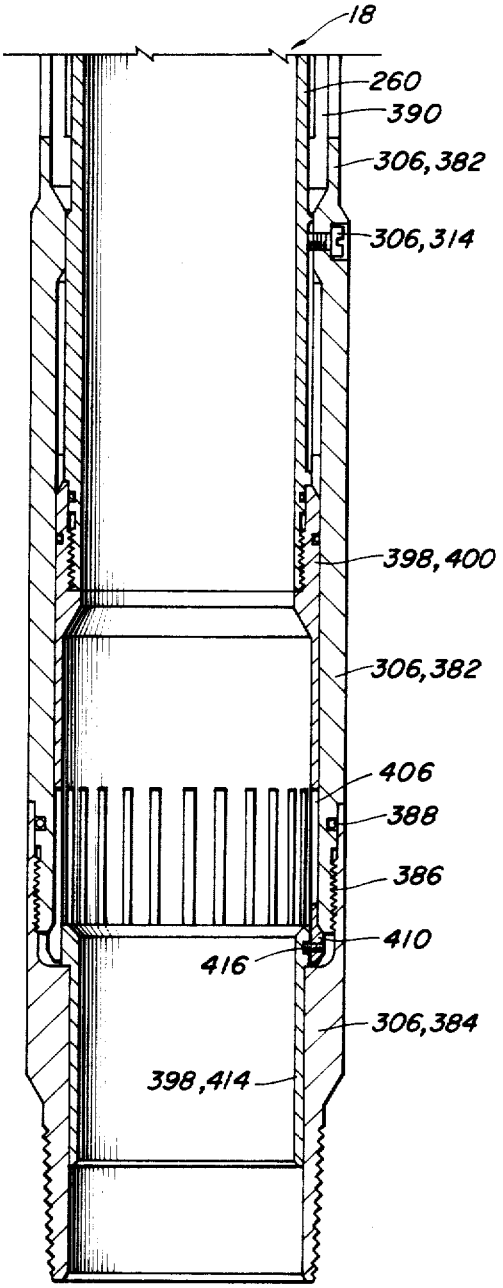

The packer apparatus 18 is shown by itself in FIGS. 2A-2B, and is shown assembled with the setting device 12 and liner valve apparatus 20 in FIGS. 1C-1F.

The packer apparatus 18 includes a packer mandrel means 260.

A mandrel connecting sleeve 262 is threadedly connected to packer mandrel means 260 at threaded connection 264.

Mandrel connecting sleeve 262 includes an internal left-handed thread 266.

The groove 186 of packer apparatus 18 within which the shear pins 184 are received to initially retain setting sleeve 176 of setting device 12 in position relative to the packer apparatus 18 is defined within an outer surface of the mandrel connecting sleeve 262.

Packer apparatus 18 includes an expandable packing means 286 including first, second and third annular packing elements 288, 290 and 292 disposed about the mandrel means 260.

An upper shoe means 284 is received about the mandrel means 260 above the packing means 286 for compressibly engaging an upper end 296 of packing means 286.

A lower shoe means 298 is received about mandrel means 260 for compressibly engaging a lower end 300 of packing means 286.

A slip means 302 is received about mandrel means 260 for anchoring the packer apparatus 18 within a well bore.

An upper wedge means 304 is received about mandrel means 260 above the slip means 302 for wedging the slip means 302 radially outward upon longitudinal compression of the packing means 286.

A lower wedge means 306 is also received about the mandrel means 260 below the slip means 302 for wedging the slip means 302 radially outward upon longitudinal compression of packing means 286.

A non-rotational connecting means 308 is operatively connected between the mandrel means 260 and each of the upper shoe means 294, lower shoe means 298, upper wedge means 304, and lower wedge means 306 for preventing rotation of each of the upper shoe means 294, lower shoe means 298, upper wedge means 304 and lower wedge means 306 relative to the mandrel means 260. As is further explained below, one important purpose of the non-rotational connecting means 308 is to prevent rotation of the various elements of the packer means 18 if the packer means 18 becomes stuck in a well bore and must be milled out of the well bore. As will be understood by those skilled in the art, if the various elements of the packer means 18 are allowed to rotate, it can be very difficult to mill the packer apparatus 18 out of the well bore.

The non-rotational connecting means 308 includes first, second and third radially inward extending pins or lugs 310, 312 and 314, respectively, which are slidably received in first, second and third longitudinally extending slots 316, 318 and 320, respectively, disposed in the mandrel means 260.

As seen in FIG. 1D, the lower shoe means 298 and the upper slip means 304 are separable non-integral structures which are fixedly connected together at threaded connection 322 so as to be longitudinally fixed relative to each other. This provides a combined lower shoe and upper wedge means 324.

The combined lower shoe and upper wedge means 324 includes a plurality of shear pins (not shown), rotationally offset from the pins 312, which initially retain the combined lower shoe and upper wedge means 324 in place relative to the manrel means 260. These shear pins engage flat bottom holes (not shown) in mandrel means 260, and are designed to prevent the packer means 18 from prematurely setting as it is run into the well.

An upper portion 326 of upper wedge means 304 and particularly an upper annular surface 328 thereof which engages the lower end 300 of packing means 286 can be generally referred to as being a portion of the lower shoe means 298 which compressibly engages the lower end 300 of packing means 286.

The upper shoe means 294 includes a main shoe housing member 330 having an inner bore 332 slidably received about an outer cylindrical surface 334 of mandrel means 260.

The main shoe housing member 330 has a tapered wedging shoulder 336 defined on an upper end thereof.

Main shoe housing member 330 includes a lower annular end surface 338 compressibly engaging the upper end 296 of packing means 286.

Also, main shoe housing member 330 includes threaded upper and lower cylindrical outer surfaces 340 and 342, respectively.

Upper shoe means 294 also includes a dog housing 344 having a cylindrical portion 346 threadedly connected to threaded upper outer surface 340 of main shoe housing member 330.

Dog housing 344 also includes an annular flange 348 extending radially inward from an upper end of the cylindrical portion 346.

A dog receiving groove 350 is defined within the upper shoe means 294 by the flange 348, the cylindrical portion 346, and the tapered wedging shoulder 336.

Upper shoe means 294 also includes an annular upper shoe ring 352 threadedly connected to threaded lower outer surface 342 of main shoe housing member 330. The upper shoe ring 352 has a lower annular surface 354 substantially flush with the lower end surface 338 of main shoe housing member 330 and compressibly engaged with the upper end 296 of packing means 286.

The packer apparatus 18 also includes a locking means 356, operatively associated with the mandrel means 260 and the upper shoe means 294 for locking the packing means 286 in a radially expanded position wherein the packing means 286 is sealed against a well bore.

The locking means 356 includes a plurality of individual locking dogs 358 received in the dog receiving groove 350 of upper shoe means 294. Each of the locking dogs 358 has a radially inner gripping surface means 360 slidably engaging the cylindrical outer surface 334 of mandrel means 260 for opposing upward motion of the dogs 358 relative to mandrel means 260. The gripping surface means 360 includes a plurality of upwardly directly teeth which bite into the outer surface 334 of mandrel means 260 and oppose upward motion of dogs 358 relative to mandrel means 260 while allowing downward motion of dogs 358 relative to mandrel means 260.

Each of the dogs 358 has a lower tapered end surface 362 engaging the tapered wedging shoulder 336 of upper shoe means 294 so that the dogs 358 are wedged radially inward against mandrel means 260 upon longitudinal compression of the packing means 286.

A resilient annular band 364 extends around the locking dogs 358 to hold them in position against the outer surface 334 of mandrel means 260.

A single Belleville spring 366 is located between an upper end of locking dogs 358 and the flange 348 of dog housing 344 to bias the locking dogs 358 downward into engagement with the tapered wedging shoulder 336.

A cylindrical outer surface 367 of packer housing section 46 of outer housing assembly 34 of setting device 12 is closely received within a bore 368 of mandrel means 260 with a seal being provided therebetween by O-ring seal means 370.

The slip means 302 includes a plurality of individual slip segments which are located about the circumference of the mandrel means 260, and only one of the slip means 302 is visible in FIGS. 1D and 1E.

A cylindrical slip housing 372 is concentrically disposed about the slip segments 302. Slip housing 372 has a plurality of windows or slots such a 546 cut therein through which the slip segments 302 may extend.

Associated with each of the slip segments 302 is an arched retracting spring 374 which is held in place between the slip segment 302 and the slip housing 372 to bias the slip segments 302 radially inward relative to slip housing 372. The slip housing 372 is attached to the upper wedge means 304 by a plurality of threaded connecting screws such as 376.

Each of the slip segments 302 includes a radially inner upper tapered surface 378 for engaging an annular wedging surface 380 of upper wedge means 304.

Lower wedge means 306 includes upper and lower sections 382 and 384 threadedly connected together at threaded connection 386 with a seal being provided therebetween by O-ring seal means 388.

The upper section 382 of lower wedge means 306 includes a plurality of upward extending wedge collet fingers 390, each having a radially outer lower wedge surface 392 defined on upper ends thereof for engagement with a radially inner lower tapered surface 393 of each slip segment 302.

The mandrel means 260 includes an intermediate cylindrical outer holding surface 394 initially located radially inward of an engaging the upper portions of wedge collet fingers 390 as seen in FIG. 1E for holding the lower wedge surface 392 in wedging engagement with the slip means 302 after the expandable packing means 286 has been longitudinally compressed to expand the packing means 286 into engagement with the well bore.

The mandrel means 260 also includes a lower reduced diameter outer releasing surface 396 located below intermediate cylindrical outer holding surface 394 for allowing the wedge collet fingers 390 to deflect radially inward and release the slip means 302 from the well bore upon upward movement of the mandrel means 260 relative to the lower wedge means 306 as is further described below.

The packer apparatus 18 further includes a selective releasing means 398 operatively associated with the mandrel means 260 and the lower wedge means 306 for releasing the packing means 286 from an expanded position wherein the packing means 286 is sealed against a well bore.

The selective releasing means 398 includes a releasing collet 400 connected at threaded connection 402 to a lower end of mandrel means 260 with a seal being provided therebetween by O-ring 404.

The releasing collet 400 includes a plurality of spring fingers such as 406 and 408 extending downward therefrom, each of which includes a radially outward extending locking lug 410 defined thereon.

Selective releasing means 398 further includes a radially inner annular lug receiving groove 412 defined in lower wedge means 306 between its upper and lower sections 382 and 384.

The locking lugs 410 of spring fingers such as 406 and 408 are normally received in the groove 412 as seen in FIG. 1F to longitudinally lock the mandrel means 260 relative to the lower wedge means 306.

The selective releasing means 398 further includes a releasing sleeve 414 which is initially releasably held by shear pins 416 in a lower position radially within the spring fingers such as 406 and 408 of releasing collet 400 to hold the locking lugs 410 in the lug receiving groove 412.

As is further explained below, the releasing sleeve 414 operates in connection with a retrieving apparatus generally designated by the numeral 418 and shown in FIGS. 3A-3B.

The releasing sleeve 414 is movable to an upper position (see FIG. 5) relative to the releasing collet 400 wherein the spring fingers such as 406 and 408 can deflect radially inward to allow the mandrel means 260 to move upward relative to the lower wedge means 306 and thereby release the packing means 286 from sealing engagement with the well bore so that the packer apparatus 18 can be retrieved in a manner further described below.

An outer cylindrical surface 420 of releasing collet 400 is closely and slidably received within a bore 422 of upper section 382 of lower wedge means 306 with a seal being provided therebetween by O-ring seal means 424.

METHODS OF SETTING THE PACKER APPARATUS AND PLACING GRAVEL THEREBELOW

To utilize the gravel packing system 10 to gravel pack a subsurface formation of a well, the work string 14, setting device 12, packer apparatus 18, liner valve means 20, screen 24 and tail pipe 28 are assembled as shown in FIGS. 1A-1F.

Then, the work string with the various attached structures is lowered into place to a desired location in the well with the screen 24 adjacent a subsurface formation which is to be gravel packed.

Then, internal pressure within the work string 14 and the central slurry supply passage 106 of setting device 12 is increased to a first value sufficient to shear the shear pins 184 (see FIG. 1C) holding setting sleeve 176 so that setting sleeve 176 is moved downward by setting piston 150 into engagement with the upper end of dog housing 344 of upper shoe means 294 of packet apparatus 18.

It is noted that the closure ball 200 will initially prevent flow of fluids out of the slurry supply passage 106 so that this first increased fluid pressure within the work string 14 is directed through the transverse passage 166 to the annular power chamber 164 adjacent setting piston 150.

Although in the preferred embodiment illustrated in FIG. 1F, the closure ball 200 is initially assembled with the setting device 12 and held in place therein by the cage 202, it is possible to delete the cage 202 and initially delete the closure ball 200 so that the setting device 12 is initially run into the well without the closure ball 200. Then the closure ball 200 may be dropped from the surface down through the work string 14 into engagement with the seat 198 after the setting device 12 has been lowered to the desired location within the well.

In a typical embodiment of the present invention the pressure required to be applied to the setting piston 150 to set the packer apparatus 18 is approximately 2,000 psi.

The previously mentioned shear pins (not shown) between the combined lower shoe and upper wedge means 324 and the mandrel means 260 will shear as soon as pressure is applied to the setting piston 150. A pressure of about 200 to 300 psi is sufficient to shear those pins.

As the setting sleeve 176 moves downward the upper shoe means 294, packing means 286, lower shoe means 298, upper wedge means 304 and slip means 302 will be longitudinally compressed between the setting sleeve 176 and the lower shoe means 306.

During this longitudinal compression, the slips 302 will first be wedged radially outward by upper and lower wedge means 304 and 306 to anchor the packer apparatus 18 within the well bore. Then, further longitudinal compression will squeeze the elements 288, 290 and 292 of packing means 286 between upper shoe means 294 and lower shoe means 298 to cause the elastomeric packing means 286 to expand radially outward and seal against the bore of the well.

After the packer apparatus 18 has been set, setting pressure can be relieved and the packer apparatus 18 is locked in its expanded position by the action of the locking dogs 358 of locking means 356.

The packer apparatus 18 can then be tested. First, approximately 10,000 pounds is pulled against the packer apparatus 18 by means of the work string 14 to test whether the slips 302 are adequately anchored within the well bore. Then, pressure is applied to the well annulus between the well casing and the work string 14 above the packer apparatus 18 to test whether the packing means 286 is completely sealed against the well bore.

Once the packer apparatus 18 has been set and tested, the supply valve means 188 must be opened. First about 10,000 pounds of weight is set down on the packer apparatus 18 by means of the work string 14 to open return valve means 114. This moves return valve sleeve 118 downward relative to outer housing assembly 34 to move sleeve port 122 into registry with housing port 124 so that the return passage 108 of setting device 12 is communicated with the well annulus exterior of the housing 32 above the packing elements 286.

Then, internal pressure within the work string 14 and the central slurry supply passage 106 is increased to a second value higher than the previously mentioned first value. In a preferred embodiment of the invention, the second value is approximately 3,000 psi, and as previously mentioned, the first value is approximately 2,000 psi. This second pressure increase acts downward across closure ball 200 and downward on supply value sleeve 190 to shear the shear pins 204 and move the supply valve sleeve 190 downward to an open position wherein its upper end 196 is located below gravel packing port 88 of housing 32 thus communicating an internal bore of the work string 14 with the open gravel packing port 88 and with the open liner valve port 228 of the liner valve means 20.

Supply valve sleeve 190 is locked in its lower open position by engagement of locking dogs 210 with groove 214.

The gravel slurry can now be pumped in place around the screen 24. As will be understood by those skilled in the art, the gravel included in this slurry is actually normally of very small size and in layman's terms would generally be referred to as sand. This sand or gravel slurry is pumped downward through the inner bore of work string 14 and through the central slurry supply passage 106 of setting device 12, then radially outward through gravel packing port 88 and liner valve port 228 into the well annulus between the screen 24 and the well bore.

The sand or gravel will be deposited in the well annulus between the screen 24 and the well bore, and the carrier fluid from the slurry will flow inward through openings schematically illustrated and designated by the numeral 426 as seen in FIG. 1H.

This return fluid will then flow upward through the bore of tail pipe 28, and through the bore 226 of check valve housing section 52 past check valve means 220 and upward into the annular return passage 108 through the setting device 12, then finally radially outward through housing port 124 and sleeve port 122 of return valve means 114 into the well annulus above the packing means 286 where it flows back upward to the earth's surface.

Once the sand or gravel has been circulated into place, it can be squeezed into the formation. This is done by first placing a tension load on the setting device 12 by pulling about 10,000 pounds with the work string 14 to return the return valve means 114 to its closed position as seen in FIGS. 1A and 1B.

Then with the return valve means 114 closed, internal pressure is once again applied to the work string 14 and the slurry supply passage 106 to squeeze the gravel or sand into the subsurface formation. Pump pressure is applied until sand-out is achieved.

Then, excess slurry can be reversed out of the work string 14. This is accomplished as follows.

The return valve means 114 is again opened by setting down 10,000 pounds on the work string 14.

Subsequently, clean fluid is pumped down the well annulus between the work string 14 and the well bore above the packing means 286. This clean fluid flows radially inward from the well annulus through sleeve port 122 and housing port 124 into the upper portion 116 of return passage 108. The clean fluid then flows downward through the annular return passage 108.

The check valve means 220 prevents flow of this clean fluid downward through the bore 226 of check valve housing section 52 and directs the clean fluid upward through the open central passageway 192 of supply valve sleeve 190, then up past closure ball 200 and upward through the slurry supply passage 106 and the bore of work string 14 to circulate any remaining slurry out of the setting device 12 and the work string 14.

The setting device 12 can now be retrieved leaving the packer apparatus 18, liner valve means 20 and screen 24 in place.

This is done by taking a slight pull with the work string 14 against the packer apparatus 18 of approximately 1,000 pounds. Right-hand rotation is then applied to the work string 14 to back off the left-hand ratchet threads connecting threaded outer surfaces 274 of connecting collet 268 to the internal left-hand threaded surface 266 of mandrel connecting sleeve 262.

Then the setting device 12 with the attached tail pipe 28 can be pulled out of engagement with the packer apparatus 18 and out of the well.

As the setting device 12 is pulled out of the packer apparatus 18, the liner valve sleeve 232 is pulled up to seal across the liner valve port 228 with the radially outward extending lugs 254 of collet fingers 248 releasably latched within groove 258 of liner valve body 230.

If necessary, the setting device 12 can be lowered back into engagement with the packer apparatus 18 reopening the liner valve means 20 so that additional sand or gravel can be placed about the screen 24. When the setting device 12 is lowered back into engagement with the packer apparatus 18, the connecting collet spring fingers 272 will allow their radially outer left-hand threaded surfaces 274 to ratchet downwardly into engagement with the internal left-hand threaded surface 266 of mandrel connecting sleeve 262.

DETAILED DESCRIPTION OF THE RETRIEVING TOOL OF FIGS. 3A-3B

After the packer apparatus 18 has been set in a well as just described, and after the setting device 12 has been withdrawn therefrom closing the liner valve means 20, a production string (not shown) will generally be lowered into engagement with the packer apparatus 18.

The production string will include a seal means on its lower end which will seal witihn the mandrel means 260 of packer means 18 in a manner similar to that in which the seal means 370 (see the upper end of FIG. 1D) of packer housing section 46 of setting device 12 sealed within that mandrel means.

The production string will be open on its lower end so that formation fluid from the subsurface formation which has been gravel packed can flow through the gravel pack and inward through the screen 24 and upward into the production string.

At this point, the packer apparatus 18 can be said to function as a production packer.

Subsequently at some point during the life of the well, it may be desired to remove the packer apparatus 18 from the well. This may occur after the packer apparatus 18 has been set within the well for an extended period of time of perhaps several years or more.

Figure 3A:
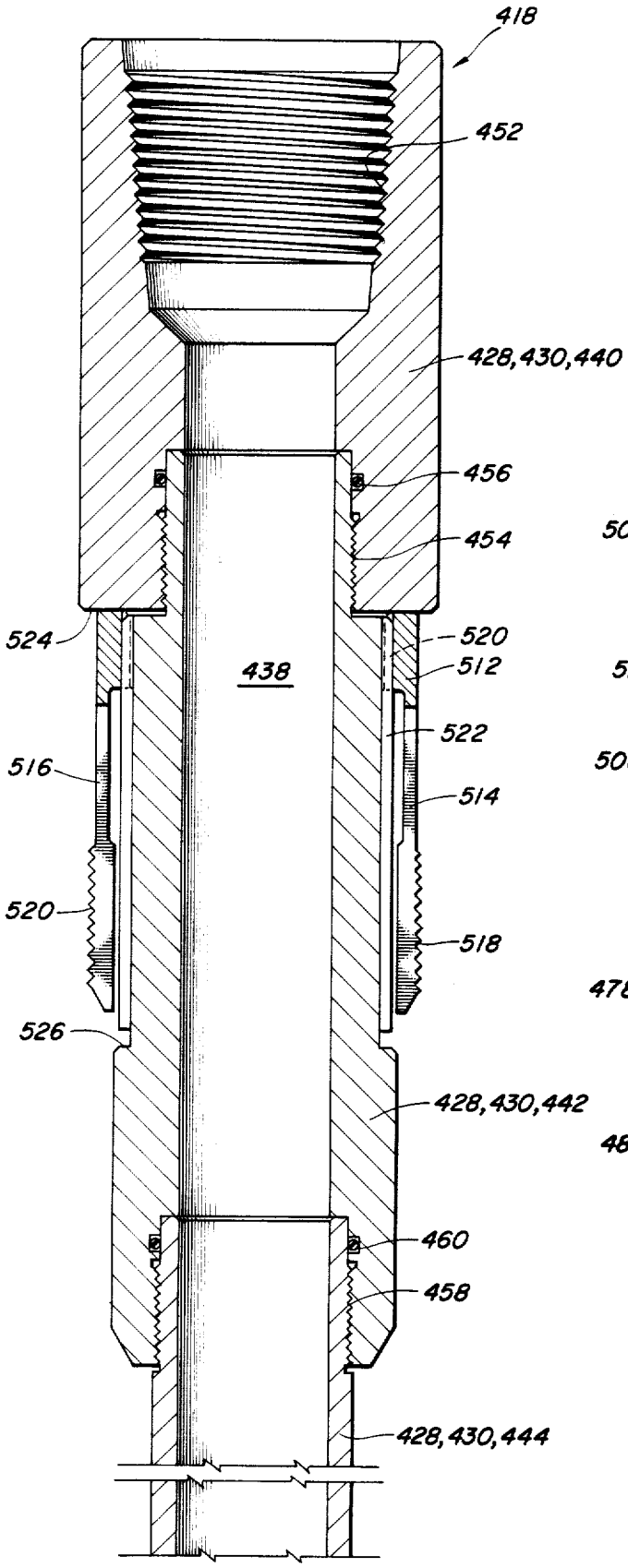
FIGS. 3A-3B comprise an elevation sectioned view of a retrieving apparatus for retrieving the liner hanger of FIGS. 2A and 2B.
Figure 3B:
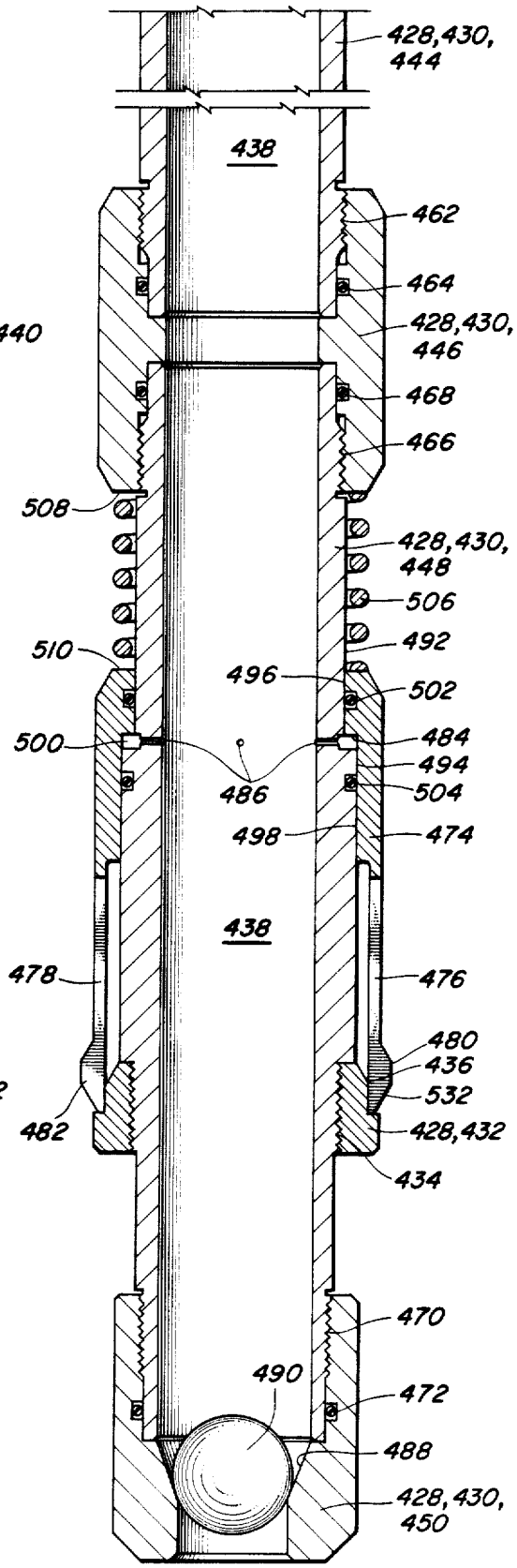

The retrieving apparatus 418 shown in FIGS. 3A and 3B is designed to retrieve the previously set packer apparatus 18 from the well.

The retrieving apparatus 418 includes an elongated body means 428 comprised of a main body member assembly 430 and a back-up ring 432 releasably attached to main body member assembly 430 by a left-hand thread means 434.

The elongated body means 428 has a back-up shoulder 436 defined on the back-up ring 432 thereof, and has a central passage 438 disposed in the main body member assembly 430 thereof.

Main body member assembly 430 includes a top coupling 440, upper mandrel 442, central mandrel 444, central coupling 446, lower mandrel 448, and a shoe 450.

The top coupling 440 has an internal threaded surface 452 for connection to a work string (not shown) on which the retrieving apparatus 418 would be lowered into the well.

Top coupling 440 is connected to upper mandrel 442 at threaded connection 454 with a seal being provided therebetween by O-ring 456.

Upper mandrel 442 is connected to central mandrel 444 at threaded connection 458 with a seal being provided therebetween by O-ring 460.

Central mandrel 444 is connected to center coupling 446 at threaded connection 462 with a seal being provided therebetween by O-ring 464.

Central coupling 446 is connected to lower mandrel 448 at threaded connection 466 with a seal being provided therebetween by O-ring 468.

The left-hand thread 434 previously mentioned which releasably connects back-up ring 432 to main body member assembly 430 is defined on the lower mandrel 448 of main body member assembly 430.

Lower mandrel 448 is connected to shoe 450 at threaded connection 470 with a seal being provided therebetween by O-ring 472.

The retrieving apparatus 418 includes a releasing collet 474 slidably disposed about lower mandrel 448 of main body member assembly 430.

Releasing collet 474 includes a plurality of downward extending spring fingers such as 476 and 478, each of which includes a radially outward extending releasing lug such as 480 and 482 defined on a lower end thereof.

Figure 4:
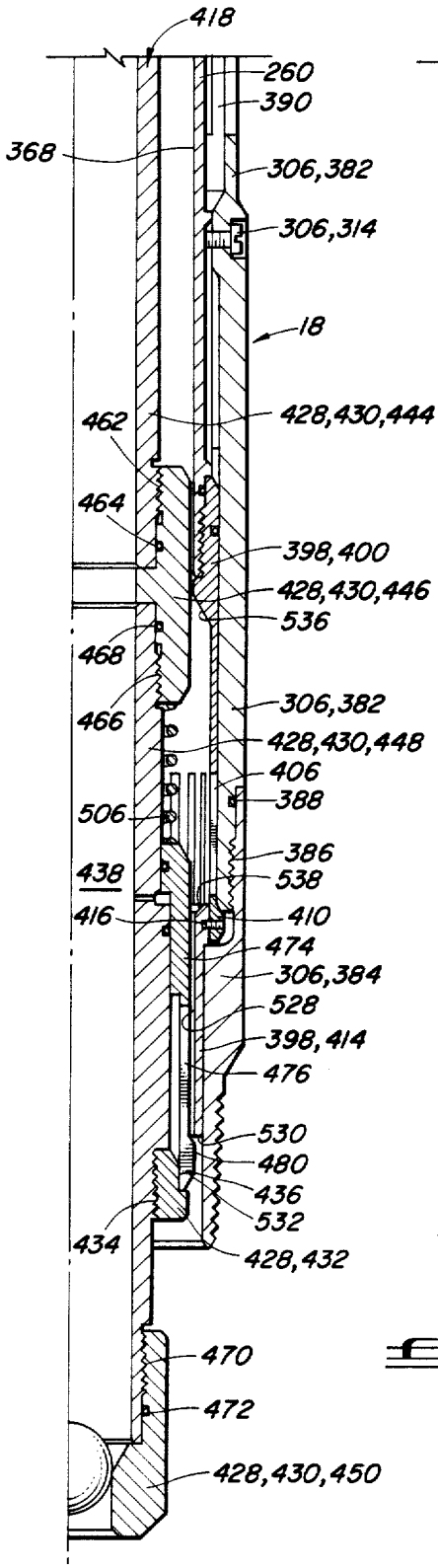
FIGS. 4, 5 and 6 are a sequential series of illustrations of the retrieving apparatus of FIGS. 3A-3B in operative engagement with the packer apparatus of FIGS. 2A-2B.
Figure 5:
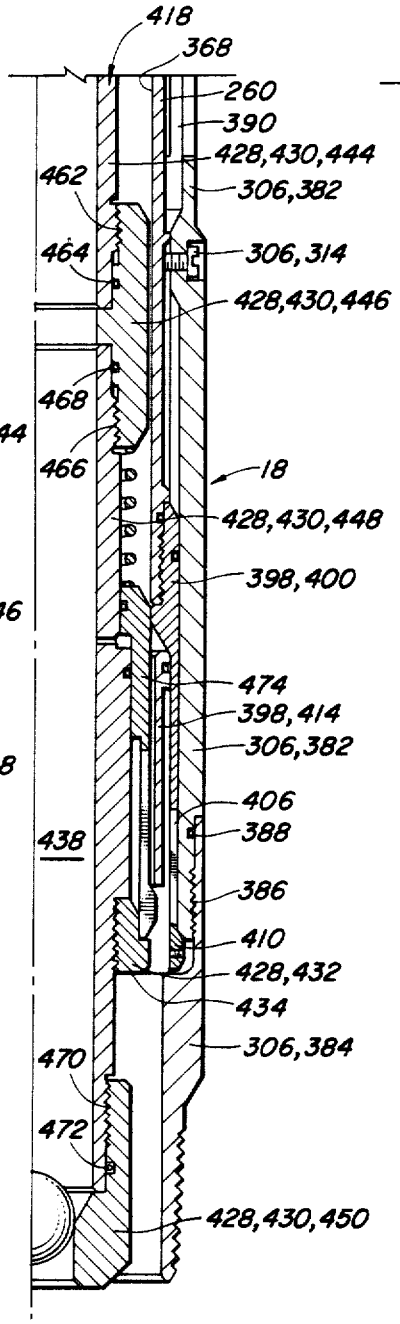

The releasing collet 474 is slidable relative to lower mandrel 448 between a lower position illustrate in FIGS. 3B, 4 and 5 wherein lower ends of the collet fingers 476 and 478 and engaged by the back-up shoulder 436 of back-up ring 432 to prevent radially inward deflection of the spring fingers 476 and 478, and an upper position (see FIG. 6) wherein the lower ends of the spring fingers are located above the back-up shoulder 436.

When the spring fingers 476 and 478 and located in their upper position above the back-up surface 436, they are free to be deflected radially inward to allow the retrieving apparatus 418 to pass through the central bore 368 of mandrel means 260 of packer apparatus 18.

The releasing collet 474 has a differential area piston means 484 defined thereon and communicated with central passage 438 through a plurality of radial bores 486 for moving the collet 474 to its upper position (see FIG. 6) relative to the lower mandrel 448 in response to an increase in fluid pressure within the central passage 438. The radial bores 486 may also be generally referred to as transverse ports 486.

The shoe 450 of body means 438 has an inner annular tapered ball receiving seat means 488 defined therein below the transverse ports 486 for receiving a ball 490 to block the central passageway 438.

The ball 490 and ball receiving seat 488 may collectively be referred to as a valve means for blocking the central passage 438 of the body means 428.

The lower mandrel 448 includes a first cylindrical outer surface 492 and a second enlarged diameter cylindrical outer surface 494.

Releasing collet 474 has a first cylindrical inner bore 496 and a second enlarged diameter cylindrical inner bore 498. The first and second cylindrical outer surfaces 492 and 494 of lower mandrel 448 are closely received within the first and second inner bores 496 and 498, respectively, of releasing collet 474 so that an annular power chamber 500 is defined between lower mandrel 448 and releasing collet 474.

The transverse ports 486 communicate the central passage 438 with the annular power chamber 500.

An upper O-ring seal 502 carried in a groove of releasing collet 474 seals between first outer surface 492 of lower mandrel 448 and first inner bore 496 of releasing collet 474 above annular power chmber 500. A lower O-ring seal 504 disposed in an outer groove of lower mandrel 448 seals between second outer surface 494 of lower mandrel 448 and second inner bore 498 of releasing collet 474 below the annular power chamber 500.

The retrieving apparatus 418 also includes a compression spring biasing means 506 disposed about lower mandrel 448 between a lower end 508 of central coupling 446 and an upper end 510 of releasing collet 474. The spring biasing means 506 continuously biases the releasing collet 474 downward toward its lower position as seen in FIG. 3B relative to the lower mandrel 448.

The retrieving apparatus 418 further includes a releasable connecting means 512 operably associated with the body means 438 for releasably connecting the body means 438 to the packer apparatus 18 upon downward insertion of the body means 428 of retrieving apparatus 418 into the central bore 368 of mandrel 260 of packer apparatus 18.

The releasable connecting means 512 is a connecting collet 512 having a plurality of downward extending connecting spring fingers such as 514 and 516, each of which includes a radially outer left-hand threaded surface such as 518 and 520 for threadedly engaging the internal left-hand threaded surface 266 (see FIG. 1C) of mandrel connecting sleeve 262 of packer apparatus 18.

The connecting collet 512 has a plurality of radially inward extending splines 520 which are meshed with a plurality of radially outward extending splines 522 of upper mandrel 442. Thus, connecting collet 512 can slide relative to upper mandrel 442 between a lower end 524 of top coupling 440 and an upward facing annular shoulder 526 of upper mandrel 442, but the connecting collet 512 is rotationally fixed relative to upper mandrel 442 by the splines 520 and 522.

The connecting collet 512 is essentially identical to the connecting collet 272 of FIG. 1C, and works in a similar manner as previously described.

When the retrieving apparatus 418 is lowered into engagement with the packer apparatus 18, the connecting collet spring fingers 512 and 516 deflect inwardly so that their left-hand threaded outer surfaces 518 and 520 ratchet downwardly into threaded engagement with the left-hand threaded inner surface 266 of packer apparatus 18. Thus, the connecting collet 512 of FIG. 3A will engage the internal left-hand threaded surface 266 of packer apparatus 18 in a manner essentially like that shown for the connecting collet 272 in FIG. 1C.

The connecting collet 512 can generally be described as a releasable connecting means 512 for releasably connecting the main body member assembly 430 of body means 428 to the packer apparatus 18 upon downward insertion of the main body member assembly 430 into the central bore 368 of mandrel means 260 of packer apparatus 18, and for disconnecting the main body member assembly 430 from the packer apparatus 18 upon right-hand rotation of the main body member assembly 430 relative to the packer apparatus 18.

METHODS OF RETRIEVING THE PACKER APPARATUS

The methods of using the retrieving apparatus 418 of FIGS. 3A-3B to retrieve the packer apparatus 18 will now be described with reference to FIGS. 4-6. It is noted that in FIGS. 4-6 the liner valve means 20 connected to the lower end of the packer apparatus 18 is not shown, but in fact the liner valve means 20 will be connected to the lower end thereof as seen in FIG. 1F.

To retrieve the previously set packer apparatus 18 from a well bore, the retrieving apparatus 418 of FIGS. 3A-3B is connected to a lower end of a work string of drill pipe and lowered into engagement with the packer apparatus 18. By merely setting down weight upon the retrieving apparatus 418, it will be pushed downward through the central bore 368 of the packer apparatus 18 until the retrieving apparatus 418 reaches the position shown in FIG. 4 relative to packer apparatus 18.

It is noted that the releasing sleeve 414 of packer apparatus 18 has an inner bore 528 of substantially the same diameter as inner bore 368 of mandrel means 260 of packer apparatus 18.

As is apparent in FIG. 4, when the releasing collet 474 of retrieving apparatus 418 is in its lower position relative to lower mandrel 448, the releasing lugs 480 of the lower ends of the releasing collet spring finger 476 span a larger diameter than the bore 368 of packer apparatus 18 and are located below a lower end 530 of releasing sleeve 414 of packer apparatus 18.

Thus it is apparent that the releasing collet 474 cannot be in its lower position as the retrieving apparatus 418 is inserted downwardly through the central bore 368 of packer apparatus 18.

As the retrieving apparatus 418 is being downwardly inserted into the packer apparatus 18, lower tapered surfaces 532 of the releasing collet spring fingers such as 476 will first engage an upward facing annular tapered surface 534 (see FIG. 1C) defined on mandrel connecting sleeve 262. This will cause the releasing collet 474 to be pushed upward relative to lower mandrel 448 compressing the spring biasing means 506 until the spring collet fingers such as 476 are moved to a position above the back-up shoulder 436 of back-up ring 432 in a manner similar to that illustrated in FIG. 6, and then the releasing collet spring fingers such as 476 are deflected radially inward so that the releasing lugs such as 480 are received within the central bore 368 of packer apparatus 18 and the retrieving apparatus 418 is allowed to slide downardly through the packer apparatus 18.

During this downward insertion of the retrieving apparatus 418, the releasing collet 474 will spring back downward to its lower position relative to lwoer mandrel 448 when the releasing lugs 480 reach a point below a downward facing tapered surface 536 (see FIG. 1F) of releasing collet 400 of packer means 18, and the releasing collet 474 will again be pushed upward compressing the biasing spring 506 when the lower tapered surfaces such as 532 of releasing lugs such as 480 of releasing collet spring fingers 476 engage an upward facing annular tapered surface 538 of releasing a sleeve 414.

Once the releasing lugs such as 480 reach a point below the lower end 530 of releasing sleeve 414, they will be moved downward relative to lower mandrel 448 by the spring biasing means 506 so that the back-up shoulder 436 will be located radially within the lower ends of the releasing collet spring fingers such as 476 to hold the releasing lugs 480 radially outward below the lower end 530 of releasing sleeve 414 as shown in FIG. 4.

Then to release and retrieve the packer apparatus 18, the retrieving apparatus 418 is pulled upward thus exerting an upward force on releasing sleeve 414 to shear the shear pins 416 which initially hold the releasing sleeve 414 in place.

Then, the retrieving apparatus 418 and releasing sleeve 414 are pulled upward relative to the packer apparatus 18 to the position shown in FIG. 5.

As the retrieving apparatus 418 is pulled further upward from the position shown in FIG. 5, the spring fingers such as 406 of releasing collet 400 of packer apparatus 18 are allowed to deflect radially inward so that the locking lugs 410 are moved out of engagement with the groove 412 of lower wedge means 306 of packer apparatus 18 thus allowing the mandrel means 260 of packer apparatus 18 to begin to move upward relative to the lower shoe means 306 of packer apparatus 18.

As the mandrel means 260 of packer apparatus 18 moves upward, the intermediate cylindrical outer holding surface 394 of mandrel means 260 (see FIG. 1E) will be moved out from under the wedge collet fingers 390 allowing the wedge collet fingers 390 to deflect radially inwardly to being releasing the slips 302 from anchoring engagement with the well bore.

Additional upward movement of mandrel means 260 of packer apparatus 18 will cause the first pin 310 of non-rotational connecting means 308 (see FIG. 1C) to bottom out in a lower end 540 of first slot 316 of non-rotational connecting means 308. This will then pull the upper shoe means 294 upward allowing the packer elements 288, 290 and 292 of packing means 286 to unset from the well bore.

As the mandrel 260 continues moving upward, the second pin 312 of non-rotational connecting means 308 (see FIG. 1D) will bottom out against a lower end 542 (see FIG. 1E) of second slot 318 of non-rotational connecting means 308 to pull the combined upper shoe and lower wedge means 324 from beneath the slips 302.

The first and second pins 310 and 312 and first and second slots 316 and 318 of non-rotational connecting means 308 can generally be described as being so arranged and constructed that a longitudinal travel of first pin 310 in first slot 316 is shorter than a longitudinal travel of second pin 312 in second slot 318, so that when the packing means 286 is being released from an expanded position and the packer apparatus 18 is being retrieved, the first pin 310 will bottom out in the first slot 316 to pull the upper shoe means 294 away from the packing means 286 before the second pin 312 bottoms out in the second slot 318 to pull the upper wedge means 304 from beneath the slip means 302.

Further upward movement of mandrel 260 shoulders a lower end 544 of a slot 546 of slip housing 372 with a lower end 548 of slips 302 pulling the slips 302 from the lower wedge means 306.

The slips 302 are then forced inward by the springs 374.

An upper tapered annular end surface 550 of releasing collet 400 of packer means 18 then shoulders on a downward facing annular tapered surface 552 (see FIG.

1E) of lower shoe means 306. The packer apparatus 18 can then be retrieved from the well.

Usually a shear mechanism is installed at some point in the liner string between the packer apparatus 18 and the screen 24 so that as the packer apparatus 18 is retrieved, the shear mechanism (not shown) shears leaving the screen 24 in place. The screen 24 can then be retrieved separately.

If the packer apparatus 18 has been in place in the well bore for several years, it may not release in the manner just described because corrosion and foreign particles may prevent the various pieces of the packer apparatus from moving as intended.

If the packer apparatus 18 is stuck in the well bore, the retrieving apparatus 418 has two separate safety features which allow it to be released from the stuck packer apparatus 18.

The first of these safety release features is provided by the differential area piston means 484 of releasing collet 474 of retrieving apparatus 418.

In the event that the packer apparatus 18 is stuck in the well bore and cannot be released, fluid pressure within the central passage 438 of retrieving apparatus 418 can be increased and transmitted through the transverse ports 486 to the annular power chamber 500 associated with the differential area piston means 44. This will cause an upward force on the releasing collet 474 which will move it to an upward position relative to lower mandrel 448 as seen in FIG. 6. As is apparent in FIG. 6, it will probably be the case that the lower mandrel 448 will actually move downward relative to the releasing collet 474.

Figure 6:
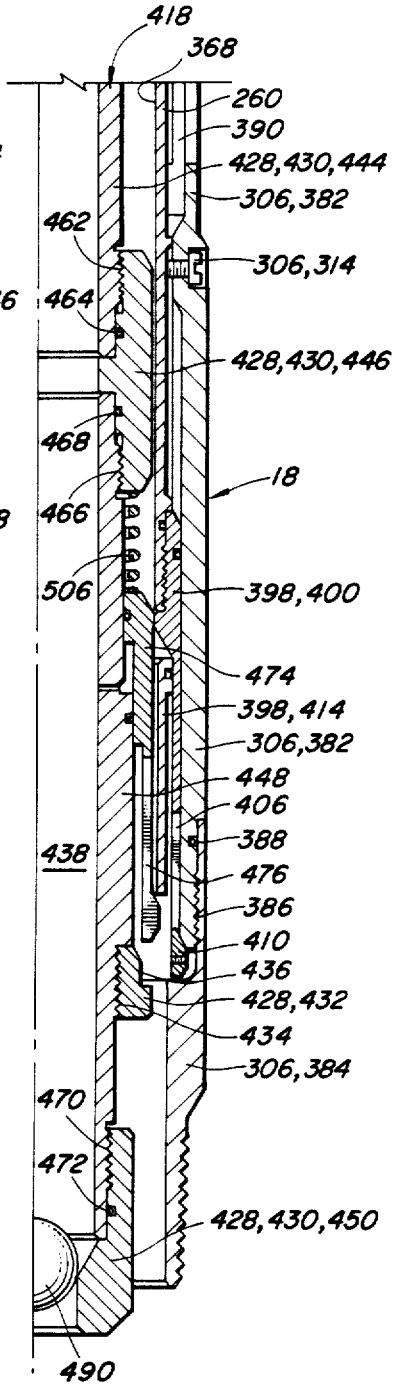

With the releasing collet 474 held in its upper position as illustrated in FIG. 6 by the increased fluid pressure within the central passage 438 of retrieving apparatus 418, the retrieving apparatus 418 can be pulled upward and the releasing collet spring fingers such as 476 will be deflected radially inward so that the retrieving apparatus 418 is allowed to be pulled upward through the central bore 368 of packer apparatus 18 out of engagement with the packer apparatus 18.

It is noted that the ball 490 closes the central passage 438 of retrieving apparatus 418 below the transverse ports 486. The ball 490 may either be run into the well with the retrieving apparatus 418 or it may be dropped through the work string attached to the retrieving apparatus 418 if it becomes necessary to utilize the safety release feature provided by the differential area piston means 484.

When using the safety release feature just described, it is also necessary to disconnect connecting collet 512 of retrieving apparatus 418 from left-hand thread 266 of packer apparatus 18. To do this, right-hand rotation must be applied to the work string and to the retrieving apparatus 418 to disconnect the left-hand threads such as 518 and 520 of connecting collet 512 from the internal left-hand threaded surface 266 of packer apparatus 18.

A second safety release feature is provided by the left-hand threaded connection 434 of back-up ring 432 to the lower mandrel 448 of body means 428.

If the packer apparatus 18 is stuck in the well, and the retrieving apparatus 418 cannot be pulled upward from the position illustrated in FIG. 5 to release the packer apparatus 18, right-hand rotation can be applied to the work string and to the retrieving apparatus 418 while maintaining an upward pull on the work string. This will rotate the main body member assembly 430 and the lower mandrel 448 thereof relative to the back-up ring 432 to disconnect lower mandrel 448 from back-up ring 432 at left-hand threaded connection 434 thus allowing the back-up ring 432 to drop downwardly relative to the lower mandrel 448 so that the releasing collet spring fingers such as 476 may then deflect radially inward allowing the retrieving apparatus 418 to be pulled upward out of engagement with the packer apparatus 18.

As the left-hand threaded connection 434 is being unthreaded during right-hand rotation of the retrieving apparatus 418, the left-hand threaded connection between connecting collet 512 and internal left-hand surface 266 of packer apparatus 18 will also be disconnected.

After the retrieving apparatus 418 has been disconnected from the stuck packer apparatus 18 in either of the manners just described, the packer apparatus 18 can be milled out of the well. Milling is a conventional technique which is well known to those skilled in the art, by means of which an annular milling tool is lowered into engagement with the packer apparatus 18 and rotated to cut the packer apparatus 18 out of the well bore.

The non-rotational connecting means 308 of packer apparatus 18, including first, second and third pins 310, 312 and 314 received in first, second and third slots 316, 318 and 320, respectively, will keep the various parts of the packer apparatus 18 from rotating during the milling procedure thus increasing the ease of milling the packer apparatus 18 out of the well bore.

Thus it is seen that the apparatus and methods of the present invention readily achieve the ends and advantages mentioned as well as those inherent therein. While certain preferred embodiments of the invention have been illustrated and described for the purposes of the present disclosure, numerous changes in the arrangement and construction of parts and steps may be made by those skilled in the art which changes are encompassed within the scope and spirit of the present invention as defined by the appended claims.

What is claimed is:

1. A setting device for a gravel packing system, said setting device comprising:

a housing having a central slurry supply passage and a fluid return passage defined therein, said return passage being an annular return passage concentrically disposed about said slurry supply passage, and having a gravel packing port disposed through a wall thereof, said housing including:

an outer housing assembly;

a lower inner housing member centrally received within said outer housing assembly and fixedly attached thereto, said gravel packing port being defined through both said lower inner housing member and said outer housing assembly; and a central flow tube, having an upper end sealingly received in an upper bore of said outer housing assembly, and having a lower end sealingly received in a bore of said lower inner housing member, a majority portion of said central supply passage being defined by a bore of said flow tube, and a majority portion of said annular return passage being defined between an outer surface of said flow tube and said outer housing assembly;

connecting means for connecting an upper end of said setting device to a work string;

weight responsive return valve means, operatively associated with said housing, for communicating an upper portion of said return passage with a well annulus exterior of said housing in response to reciprocation of said work string and for communicating said upper portion of said return passage with said well annulus in response to setting weight down on said setting device, said return valve including:

a return valve sleeve slidably disposed about an upper outer surface of said housing and having a sleeve port disposed therethrough;

a housing port disposed through said housing and communicated with said upper portion of said return passage, said housing port being arranged to be in registry with said sleeve port when weight is set down on said setting device and said return valve sleeve is in a lower position relative to said housing; and seal means, disposed between said housing and said return valve sleeve, for isolating said housing port from said sleeve port when a tension load is placed across said setting device and said valve sleeve is in an upper position position relative to said housing;

hydraulic setting piston means, operatively associated with said housing and communicated with said supply passage, for setting a liner hanger of said gravel packing system in response to a first increase in fluid pressure in said supply passage to a first valve;

hydraulically actuated supply valve means, operatively associated with said housing, for communicating said gravel packing port with said supply passage in response to a second increase in fluid pressure in said supply passage to a second value greater than said first valve, said supply valve means including:

a sliding supply valve sleeve having an open central passageway extending therethrough and open at both a lower and upper end of said sleeve, said passageway communicating with said slurry supply passage and having a ball receiving seat means, defined on the upper end thereof;

a closure ball adpated for seating on said ball receiving seat means of said sliding supply valve sleeve, said closure ball for use in closing said open central passageway of said sliding supply valve sleeve and to allow said sleeve to be forced downward relative to said housing in response to said second increase in fluid pressure in said supply passage;

a retaining cage disposed in a portion of said housing for retaining said closure ball within said housing;

releasable retaining means, operatively associated with said supply valve sleeve and said housing, for initially retaining said supply valve sleeve in a closed position blocking said gravel packing port;

and locking means, operatively associated with said supply valve sleeve and said housing, for locking said supply valve sleeve in its said open position;

and check valve means, disposed in a lower portion of said housing below said supply valve means, for permitting flow of return fluid upward therethrough, for permitting downward flow therethrough, and for directing reverse circulation fluid up through said open central passageway of said supply valve sleeve and up through said slurry supply passage to remove excess slurry from said setting device.

2. A gravel packing system including the setting device of claim 1, and further comprising:

a said liner hanger releasably connected to said setting device; and a liner valve means, connected to a lower end of said liner hanger, and having a lower portion of said housing received therein so that said gravel packing port of said setting device is in registry with a liner valve port.

3. The system of claim 2, wherein:

said liner valve means includes a liner valve body and a liner valve sleeve slidably disposed in said liner valve body; and said liner valve sleeve is operably associated with said housing of said setting device, so that when said housing is received in said liner valve means, said liner valve sleeve is located below said liner valve port and said gravel packing port is communicated with said liner valve port, and so that when said housing is withdrawn from said liner valve means, said liner valve sleeve is moved to an upper position relative to said liner valve body blocking said liner valve port.

4. The system of claim 3, wherein:

said liner valve means further includes releasable latching means for releasably latching said liner valve sleeve in its upper position.

5. The system of claim 3, wherein:

said liner valve sleeve includes a plurality of downward extending spring collet fingers, each having a lower head including both a radially inward and a radially outward exending lug; and said setting device and said liner valve means are so arranged and constructed that when said housing is received in said liner valve means with said gravel packing port in registry with said liner valve port, said collet fingers are cammed radially inward so that said inward extending lugs are latched in an annular outer groove of said housing so that said liner valve sleeve is releasably longitudinally fixed relative to said housing, and when said housing is withdrawn from said liner valve means, said liner valve sleeve is pulled upward with said housing relative to said liner valve body until said spring collet fingers spring radially outward to disengage from said housing.

6. The setting device of claim 1, wherein:

said setting piston means is slidably received about an outer surface of said housing such that an annular power chamber is defined between said housing and said setting piston means;

said housing has a transverse passage defined therein communicating said central supply passage with said annular power chamber, said transverse passage extending transversely through, but being isolated from, said annular return passage; and said gravel packing port extends transversely through, but is isolated from, said annular return passage.

* * * * *

UNITED STATES PATENT AND TRADEMARK OFFICE

CERTIFICATE OF CORRECTION

PATENT NO. : 4,726,419

DATED : February 23, 1988

INVENTOR(S) : Gary D. Zunkel

It is certified that error appears in the above-identified patent and that said Letters Patent is hereby corrected as shown below:

In column 14, line 1, delete the word [packet] and insert therefor --packer--.

In column 15, line 6, delete the word [value] and insert therefor --valve--.

In colomn 19, line 57, delete the word [lwoer] and insert therefor --lower--.

In column 21, line 26, delete the numeral [44] and insert therefor --484—.

Signed and Sealed this

Twenty-eighth Day of June, 1988

*Attest:*

*Attesting Officer*

DONALD J. QUIGG

*Commissioner of Patents and Trademarks*